US007776368B2

(12) United States Patent
Hamann

(10) Patent No.: US 7,776,368 B2
(45) Date of Patent: Aug. 17, 2010

(54) GLOVES CONTAINING DRY POWDERED ALOE AND METHOD OF MANUFACTURING

(75) Inventor: Curtis P. Hamann, Paradise Valley, AZ (US)

(73) Assignee: SmartHealth, Inc., Phoenix, AZ (US)

( * ) Notice: Subject to any disclaimer, the term of this patent is extended or adjusted under 35 U.S.C. 154(b) by 10 days.

(21) Appl. No.: 10/640,192

(22) Filed: Aug. 13, 2003

(65) Prior Publication Data

US 2005/0037054 A1 Feb. 17, 2005

(51) Int. Cl.
*A61K 36/886* (2006.01)

(52) U.S. Cl. ..... 424/744

(58) Field of Classification Search ..... 424/744, 424/767

See application file for complete search history.

(56) References Cited

U.S. PATENT DOCUMENTS 3,025,403 A 3/1962 Belknap et al.
3,059,241 A 10/1962 O'Brien et al.
3,225,360 A 12/1965 Keilen, Jr. et al.
3,286,011 A 11/1966 Kavalir et al.
3,397,265 A 8/1968 Ansell
3,813,695 A 6/1974 Podell Jr. et al.
3,933,723 A 1/1976 Grenness
3,942,193 A 3/1976 Pugh
4,061,709 A 12/1977 Miller et al.
4,064,564 A * 12/1977 Casey ..... 2/168
4,070,713 A 1/1978 Stockum
4,185,330 A 1/1980 Stager
4,186,445 A 2/1980 Stager
4,251,574 A 2/1981 Berend
4,302,852 A 12/1981 Joung
4,340,348 A 7/1982 Kurtz
4,371,988 A 2/1983 Berend
4,390,492 A 6/1983 Kurtz
4,463,156 A 7/1984 McGary, Jr. et al.
4,482,577 A 11/1984 Goldstein et al.
4,499,154 A 2/1985 James et al.
4,548,844 A 10/1985 Podell et al.
4,575,476 A 3/1986 Podell et al.
4,696,065 A 9/1987 Eleneteny
4,917,850 A 4/1990 Gray
4,954,309 A 9/1990 McGlothlin et al.
5,001,354 A 3/1991 Gould et al.
5,014,361 A 5/1991 Gray
5,020,162 A 6/1991 Kersten et al.
5,088,125 A 2/1992 Ansell et al.
5,112,900 A 5/1992 Buddenhagen et al.
5,215,701 A 6/1993 Gould et al.
5,272,771 A 12/1993 Ansell et al.
5,284,607 A 2/1994 Chen
5,370,915 A 12/1994 Hirakawa
5,395,666 A 3/1995 Brindle
5,405,666 A 4/1995 Brindle
5,405,690 A 4/1995 Hirakawa
5,407,715 A 4/1995 Buddenhagen et al.
5,444,121 A 8/1995 Grennes et al.
5,458,936 A 10/1995 Miller et al.
5,459,879 A 10/1995 Fuchs
5,483,697 A 1/1996 Fuchs
5,568,657 A 10/1996 Cordova et al.
5,570,475 A 11/1996 Nile et al.
5,598,850 A 2/1997 Miller et al.
5,601,092 A 2/1997 Miller et al.
5,612,083 A 3/1997 Haung et al.
5,614,202 A 3/1997 DeFina
5,620,773 A 4/1997 Nash
5,644,798 A 7/1997 Shah
5,651,995 A 7/1997 Oyama et al.
RE35,616 E 9/1997 Tillotson et al.
5,682,613 A 11/1997 Dinatale
5,691,069 A 11/1997 Lee
5,691,446 A 11/1997 Dove
5,700,585 A 12/1997 Lee
5,708,132 A 1/1998 Grimm
5,712,346 A 1/1998 Lee
5,741,885 A 4/1998 Dove
5,742,943 A 4/1998 Chen (Continued)

FOREIGN PATENT DOCUMENTS

CN 1403497 A * 3/2003

(Continued)

OTHER PUBLICATIONS

Internet website; http://www.heathtouch.com/bin/EContent_HT/altCareMedShowLfts.asp?fname=00413&tit. only 2 pages.*

(Continued)

*Primary Examiner*—Christopher R Tate
*Assistant Examiner*—Deborah A. Davis
(74) *Attorney, Agent, or Firm*—Reinhart Boerner Van Deuren P.C.

(57) ABSTRACT

An article includes a flexible impermeable elastomer glove with a dry powdered Aloe and/or dry powdered Nopal (with or without dry additive(s)) applied to a dry wearer-contacting surface of the glove. A method of making the article and a method of applying the dry powdered Aloe and/or dry powdered Nopal (with or without dry additive(s)) to the article are also provided.

21 Claims, 2 Drawing Sheets

U.S. PATENT DOCUMENTS

| | | | | |
|---|---|---|---|---|
| 5,800,818 | A | 9/1998 | Prugnaud et al. | |
| 5,807,941 | A | 9/1998 | Tsuji et al. | |
| 5,833,915 | A | 11/1998 | Shah | |
| 5,851,683 | A | 12/1998 | Plamthottam et al. | |
| 5,869,072 | A | 2/1999 | Berry | |
| 5,877,244 | A | 3/1999 | Hoover et al. | |
| 5,881,386 | A | 3/1999 | Horwege et al. | |
| 5,881,387 | A | 3/1999 | Merovitz et al. | |
| 5,900,452 | A | 5/1999 | Plamthottam | |
| 5,910,533 | A | 6/1999 | Ghosal et al. | |
| 5,965,276 | A | 10/1999 | Shienker et al. | |
| 5,974,589 | A | 11/1999 | Pugh et al. | |
| 5,985,955 | A | 11/1999 | Bechara et al. | |
| 5,993,923 | A | 11/1999 | Lee | |
| 5,997,969 | A | 12/1999 | Gardon | |
| 6,000,061 | A | 12/1999 | Taneja et al. | |
| 6,016,570 | A | 1/2000 | Vande Pol et al. | |
| 6,017,997 | A | 1/2000 | Snow et al. | |
| 6,019,922 | A | 2/2000 | Hassan et al. | |
| 6,031,042 | A | 2/2000 | Lipinski | |
| 6,066,697 | A | 5/2000 | Coran et al. | |
| 6,099,866 | A | 8/2000 | Slimak | |
| 6,121,366 | A | 9/2000 | Sharma | |
| 6,213,123 | B1 | 4/2001 | Miller et al. | |
| 6,221,447 | B1 | 4/2001 | Munn et al. | |
| 6,242,042 | B1 | 6/2001 | Goldstein et al. | |
| 6,254,947 | B1 | 7/2001 | Schaller | |
| 6,274,154 | B1 * | 8/2001 | Chou | 424/402 |
| 6,280,673 | B1 | 8/2001 | Green et al. | |
| 6,284,856 | B1 | 9/2001 | Lee | |
| 6,288,159 | B1 | 9/2001 | Plamthottam | |
| 6,306,514 | B1 | 10/2001 | Welkel et al. | |
| 6,345,394 | B1 | 2/2002 | Nakamura et al. | |
| 6,347,408 | B1 | 2/2002 | Yeh | |
| 6,369,154 | B1 | 4/2002 | Suddaby | |
| 6,380,283 | B1 | 4/2002 | Perrella et al. | |
| 6,391,409 | B1 | 5/2002 | Yeh et al. | |
| 6,414,083 | B2 | 7/2002 | Plamthottam | |
| 6,423,328 | B2 * | 7/2002 | Chou | 424/402 |
| 6,440,498 | B2 | 8/2002 | Schaller | |
| 6,447,820 | B1 | 9/2002 | Niazi | |
| 6,465,591 | B1 | 10/2002 | Lee | |
| 6,488,948 | B1 | 12/2002 | Danielli | |
| 6,589,544 | B2 | 7/2003 | Leong | |
| 6,630,152 | B2 | 10/2003 | Chou | |
| 6,673,054 | B1 * | 1/2004 | Gould et al. | 604/292 |
| 7,455,863 | B2 | 11/2008 | Hamann | |
| 2001/0048937 | A1 | 12/2001 | Chou | |
| 2002/0025335 | A1 | 2/2002 | Chou | |
| 2002/0102317 | A1 | 8/2002 | Gutterrez | |
| 2002/0110584 | A1 | 8/2002 | Chou | |
| 2002/0114825 | A1 | 8/2002 | Leong | |
| 2002/0132021 | A1 | 9/2002 | Raskin et al. | |
| 2003/0017193 | A1 | 1/2003 | Chou | |
| 2003/0118761 | A1 * | 6/2003 | Triebes et al. | 428/35.7 |
| 2003/0204893 | A1 | 11/2003 | Chou | |
| 2003/0217416 | A1 * | 11/2003 | Litke et al. | 8/94.32 |
| 2004/0057917 | A1 * | 3/2004 | Wolf et al. | 424/59 |
| 2004/0091504 | A1 | 5/2004 | Hamann | |
| 2004/0091519 | A1 * | 5/2004 | Amdur, III | 424/443 |
| 2007/0104904 | A1 | 5/2007 | Hamann | |
| 2007/0207282 | A1 | 9/2007 | Hamann | |

FOREIGN PATENT DOCUMENTS

| | | | |
|---|---|---|---|
| EP | 0232239 A2 * | 8/1987 | |
| JP | 11229211 | 8/1999 | |
| SU | 806138 B * | 2/1981 | |

OTHER PUBLICATIONS

Ahmad, A.., et al.; Antiviral Properties of Extract of *Opuntia streptacantha*; Antiviral Research (1996) pp. 75-85, vol. 30, Elsevier Science B.V.

Park, et al.; Wound Healing Activity of *Opuntia ficus;indica*; Filoterapia, (2001), pp. 165-167, 72, Elsevier Science B.V.

Loro, J.F., et al.; Preliminary Studies of Analgesic and Anti-Inflammatory Properies of *Opuntia dillenii* Aqueous Extract; Jounal of Ethnopharmacology, (1999), pp. 213-218, vol. 67, Elsevier Science Ireland Ltd.

Park, et al.; An Anti-Inflammatory Principle from Cactus; Filoterapia, (2001), pp. 288-290, 72, Elsevier Science B.V.

Park, et al.; Studies on the pharmacological action of cactus: indentification of its anti-inflammatory effect; Archives of Pharmacal Research, Feb. 1998, vol. 21, Issue 1, Abstract-Medline.

Budinsky, A., et al.; Regular Ingestion of *Opuntia robusta* Lowers Oxidation Injury; Prostaglandins, Leukotrienes and Essential Fatty Acids, (2001), pp. 45-50, vol. 65(1), Harcourt Publishers Ltd.

ASTM Standards D3578-01a$^{\in 2}$; Standard Specification for Rubber Examination Gloves, (Jan. 2002), pp. 1-5.

ASTM Standards D6124-01; Standard Test Method for Residual Powder on Medical Gloves, (Sep. 2001), pp. 1-4.

www.iasc.org, International Aloe Science Council, Certification Program.

www.NHKlabs.com (Jan. 27, 2003), pp. 1-5, NHK Laboratories Ingredient Marketplace.

www.sardagum.com, (Jan. 27, 2003), pp. 1-2, Sarda Gums & Chemicals.

Galati, E.M. et al.; Biological Effect of *Opuntia ficus* Indica (L.) Mill. (Cactaceae) Waste Matter Note I: Diuretic Activity; Publication; Journal of Ethnophamacology, 2002, pp. 17-21, 5 pages; vol. 79, Elsevier Science Ireland Ltd.

Lahsasni, S. et al.; Experimental Study and Modeling of Adsorption and Desorption Isotherms of Prickly Pear Peel (*Opuntia ficus* Indica); Publication; Journal of Food Engineering, 2002, pp. 201-207, 7 pages; vol. 55, Elsevier Science Ltd.

Lee, E. et al.; Effects of *Opuntia ficus*-Indica var. Saboten Stem on Gastric Damages in Rats; Feb. 2002; ScienceDirect—Archives of Pharmacal Research: Effects of *Opuntia ficus*-indica va. Sab . . . ; 1 page.

Carrillo-Lopez, A. et al.; Hydrolytic Activity and Ulstrastructural Changes in Fruit Skins from Two Prickly Pear (*Opuntia* sp.) Varieties During Storage; Mar. 13, 2002; ScienceDirect—Journal of Agricultural and Food Chemistry: Hydrolytic activity and ultra . . . ; 1 page.

Monje, P. et al.; Characterization of Calcium Oxalates Generated as Biominerals in Cacti; Feb. 2002; ScienceDirect- Plant Physiology: Characterization of calcium oxalates generated as biom . . . ; 1 page.

Lahsasni, S. et al.; Moisture Adsorption-Desorption Isotherms of Prickly Pear Cladode (*Opuntia ficus indica*) at Different Temperatures; Publication; Energy Conversion and Management 44, 2003, pp. 923-936, 14 pages, Elsevier Science Ltd.

Van De Water, Peter K.; The Effect of Chemical Processing on the $\hat{o}^{13}C$ Value of Plant Tissue; Publication; Geochimica et Cosmochimica Acta, 2002, pp. 1211-1219, 9 pages; vol. 66, No. 7, Elsevier Science Ltd., USA.

Nyffeler, R.; Phylogenetic Relationships in the Cactus Family (Cactaceae) Based on Evidence from TrnKl MatK and TrnL-TrnF Sequences; Publication; American Journal of Botany, 2002, pp. 312-326, 15 pages; vol. 89(2).

The Nopal; hhtp://www.elbalero.gob.mx/kids/about/did/nopal.html Oct. 8, 2002; website; 2 pages.

The Nopal Trade Products; http://www.thenopaltrade.com/nopal-plants.html Oct. 9, 2002; website; 3 pages.

Nopal (definition of); Merriam-Webster's Collegiate Dictionary; 2002; 2 pages.

Prickly Pear (definition of); Merriam-Webster's collegiate Dictionary; 2002; 3 pages.

Galati, E.M. et al.; Antiulcer Activity of *Opuntia ficus* Indica (L.) Mill. (Cactaceae); Ultrastructural Study; Publication; Journal of Ethnophamacology, 2001, pp. 1-9, 9 pages; vol. 7, Elsevier Science Ireland Ltd.
Fernandez-Lopez, J. et al.; Application of High-Performance Liquid Chromatography to the Characterization of Betalain Pigments in Prickly Pear Fruits; Publication; Journal of Chromatography A; 2001, pp. 415-420, 6 pages; vol. 913, Elsevier Science B.V.
Majdoub, M., et al.; Prickly Pear Nopals Pectin from *Opuntia ficus*-Indica Physico-Chemical Study in Dilute and Semi-Dilute Solutions; Publicaiton; Carbohydrate Polymers, 2001, pp. 69-79, 11 pages; vol. 46, Elsevier Science Ltd.
Bwititi, P. et al.; Effects of *Opuntia megacantha* on Blood Glucose and Kidney Function in Streptozotocin Diabetic Rats; Publication; Journal of Ethnopharmacology, 2000, pp. 247-252, 6 pages; vol. 69, Elsevier Science Ireland Ltd.
Piga, A. et al.; Influence of Storage Temperature on Shelflife of Minimally Processed Cactus Pear Fruits; Publication; Lebensm.-Wiss. U.-Technol, 2000, pp. 15-20, 6 pages; vol. 33, Academic Press.
Veronin, M.A. et al.; The Validity of Health Claims on the World Wide Web; a Systematic Survey of the Herbal Remedy *Opuntia*; Sep.-Oct. 2000; ScienceDirect—American Journal of Health Promotion, 1 page.
Ram, M. et al.; Wound Response and Regeneration in Coelarthrum *Opuntia*; Publication; Aquatic Botany, 2000, pp. 345-351, 7 pages; vol. 68, Elsevier.
North, G. et al.; Heterogeneity in Water Availability Alters Cellular Development and Hydraulic Conductivity along Roots of a Desert Succulent; Publication; Annals of Botany, 2000, pp. 247-255, 9 pages; vol. 85, Annals of Botany Company.
Saenz, C.; Processing Technologies: an Alternative for Cactus Pear (*Opuntia* spp.) Fruits and Cladodes; Publication; Journal of Arid Environments, 2000, pp. 209-225, 17 pages; vol. 46, Academic Press.
Contreras-Esquivel, J.C. et al.; Pectinesterase Extraction from Mexican Lime (Citrus *Aurantifolia swingle*) and Prickly Pear (*Opuntia ficus indica* L.) Peels; Publication; Food Chemistry, 1999, pp. 153-156, 4 pages; vol. 65, Elsevier Science Ltd.
Cardenas, A. et al.; Rheology and Aggregation of Cactus (*Opuntia ficus-indica*) Mucilage in Solution; Publication; Journal of the Professional Association of Cactus Development, 1998, pp. 152-159, 13 pages; vol. 2.
Trejo-Gonzalez, A. et al.; A Purified Extract from Prickly Pear Cactus (*Opuntia fuliginosa*) Controls Experimentally Induced Diabetes in Rats; Publication; Journal of Ethnophamacology, 1996, pp. 27-33, 7 pages; vol. 55, Elsevier Science Ireland Ltd.
Palermo, J. et al.; Short Side Chain Sterols from the Tunicate Polizoa *Opuntia*; Publication; Steroids, 1996, pp. 2-6, 5 pages; vol. 61, Elsevier Science, Inc., New York, USA.
Mohamed-Yasseen, Y. et al.; A Note on the Uses of *Opuntia* spp. In Central/North America; Publication; Journal of Arid Environments, 1996, pp. 347-353, 7 pages; vol. 32, Academic Press Limited.
Roman-Ramos, R. et al.; Anti-Hyperglycemic Effect of Some Edible Plants; Publication; Journal of Ethnopharmacology, 1995, pp. 25-32, 8 pages; vol. 48, Elsevier Science Ireland Ltd.
Padiglia, A. et el.; Purification and Characterization of *Opuntia peroxidase*; Publication; Phytochemistry, 1995, pp. 295-297, 3 pages; vol. 38, No. 2, Elsevier Science Ltd., Great Britain.
North, G. et al.; Cladode Development for *Opuntia ficus-indica* (Cactaceae) Under Current and Doubled $CO_2$ Concentrations; Publication; American Journal of Botany, 1995, pp. 159-166, 8 pages; vol. 82(2).
Wang, N. et al.; Phloem Exudate Collected via Scale Insect Stylets for the CAM Species *Opuntia ficus-indica* under Current and Doubled $CO_2$ Concentrations; Publication; Annals of Botany, 1995, pp. 525-532, 8 pages; vol. 75, Annals of Botany Company.
Nobel, P. et al.; Light, Chlorophyll, Carbonxylase Activity and $CO_2$ Fixation at Various Depths in the Chlorenchyma of *Opuntia ficus-indica* (L.) Miller Under Current and Elevated $CO_2$; Publication; New Phytol., 1994, pp. 315-322, 8 pages; vol. 128.
Hamann, et al.; Allergies Associated with Medical Gloves—Manufacturing Issues; Publication; Occupational Dermatoses, Jul. 1994, pp. 547-559, 13 pages; vol. 12, No. 3.
Saenz, C. et al.; Colour Changes in Concentrated Juices of Prickly Pear (*Opuntia ficus indica*) During Storage at Different Temperatures; Lebensmittel-Wissenschaft und-Technologie, Oct. 1993; Science Direct; 1 page.
Savio, Y.; Nopal Facts, Publication; University of California, Davis, Jun. 1989; 11 pages.
Prickly Pear Cactus; Small Farm Center, Publication; Cooperative Extension, University of California, Davis, CA, Jul. 1989; 7 pages.
Mauseth, J.; Introduction to Cactus Anatomy, Part 5, Secretory Cells; Publication; Cactus & Succulent Journal (U.S.), 1983, pp. 171-175, 5 pages; vol. 55.
Nobel, P.; Nutrient Levels in Cacti—Relation to Nocturnal Acid Accumulation and Growth; Publication; Amer. J. Bot.; 1983, pp. 1244-1253, 10 pages; vol. 70(8).
Pinkava, D. et al.; Chromosome Numbers in Some Cacti of Western North America, IV; Publication; Bulletin of the Torrey Botanical Club, Apr.-Jun. 1982, pp. 121-128, 8 pages; vol. 109, No. 2.
Breckenridge et al.; Echinocereus; Publication; Systematic Botany, 1982, pp. 370-378, 9 pages; vol. 7.
Trachtenberg, S. et al.; The Mucilage Cells of *Opuntia ficus-indica* (L.) Mill.-Development, Ultrastructure, and Mucilage Secretion; Publication; Bot. Gaz., 1981, pp. 206-213, 8 pages; vol. 142(2).
Mauseth, J.; A Stereological Morphometric Study of the Ultrastructure of Mucilage Cells in *Opuntia polyacatha* (Cactaceae); Publication; Bot. Gaz., 1980, pp. 374-378, 5 pages; vol. 141(4).
Parfitt, B.; Origin of *Opuntia curvospina* (Cactaceae); Publication; Systematic Botany, 1980, pp. 408-418, 11 pages; vol. 5(4).
Mauseth, J.; Release of Whole Cells of Nopalea (Caciaceae) into Secretory Canals; Publication; Bot. Gaz., 1980, pp. 15-18, 4 pages; vol. 141(1).
Conde, L.; Anatomical Comparisons of Five Species of *Opuntia* (Cactacease); Publication; Ann. Missouri Bot. Gard., 1975, pp. 425-473, 49 pages; vol. 62.
Thomson, W.W. et al.; Studies on the Ultrastructure of the Guard Cells of *Opuntia*; Publication; Amer. J. Bot., 1970, pp. 309-316, 8 pages; vol. 57(3).
Cabrera, L.; Plantas Curativas de Mexico; Propiedades Medicinales de las Mas Conocidas Plantas de Mexico; Publication, 1943, Segunda Edicion; Ediciones Ciceron, Mexico, D.F.; pp. 163-164, 3 pages.
Chemical Characters of Cacti; Biology, Taxonomy, and Ecology, Part One, pp. 83-87; 5 pages.
Malainine, M. et al.; Structure and Morphology of Cladodes and Spines of *Opuntia ficus-indica*. Celulose Extraction and Characterization; Publication; Carbohydrate Polymers, 2003, pp. 77-83, 7 pages; vol. 51, Elsevier Science Ltd.
ASTM—Designation D 412-98a—Standard Test Methods for Vulcanized Rubber and Thermoplastic Elastomers-Tension, Publication; Aug. 1998; pp. 1-13, 13 pages.
ASTM—Designation D 573-99—Standard Test Methods for Rubber-Deterioration in an Air Oven, Publication; Dec. 1999, pp. 1-6, 6 pages.
ASTM—Designation D 3577-01a$^{\in 2}$—Standard Specification for Rubber Surgical Gloves, Publication, Jan. 2002, pp. 1-4. 4 pages.
ASTM—Designation D 3767-01—Standard Practice for Rubber—Measurement of Dimensions, Publication; Mar. 2001; pp. 1-7, 7 pages.
ASTM—Designation D 4679-02—Standard Specification for Rubber General Purpose, Household or Beautician Gloves, Publication; Mar. 2002; pp. 1-3, 3 pages.
ASTM—Designation D 5151-99—Standard Test Method for Detection of Holes in Medical Gloves, Publication; Jun. 1999; pp. 1-2, 2 pages.
ASTM—Designation D 5250-00$^{\in 4}$—Standard Specification for Poly (vinyl chloride) Gloves for Medical Application, Publication; Feb. 2000; pp. 1-3, 3 pages.
ASTM—Designation D 5712-99—Standard Test Method for The Analysis of Aqueous Extractable Protein in Natural Rubber and Its Products Using the Modified Lowry Method, Publication; Sep. 1999; pp. 1-7, 7 pages.
ASTM—Designation D 6319-00a$^{\in 3}$—Standard Specification for Nitrile Examination Gloves for Medical, Publication, Jan. 2001, pp. 1-4. 4 pages.

ASTM—Designation D 6355-98—Standard Test Method for Human Repeat Insult Patch Testing of Medical Gloves, Publication; Feb. 1999; pp. 1-6, 6 pages.
ASTM—Designation D 6499-00—Standard Test Method for The Immunological Measurement of Antigenic Protein in Natural Rubber and its Products, Publication; Mar. 2000; pp. 1-6, 6 pages.
ASTM—Designation F 1671-97b—Standard Test Method for Resistance of Materials Used in Protective Clothing to Penetration by Blood-Borne Pathogens Using Phi-X174 Bacteriophage Penetration as a Test System, Publication; Feb. 1998; pp. 1-10, 10 pages.
ISO-10282—Single-use sterile surgical rubber gloves, Specification; First edition, Publication; Dec. 1, 1994; pp. i-8, 10 pages.
ISO-11193—Single-use medical examination gloves—Specification First edition, Publication, Dec. 1, 1994; pp. i-7, 9 pages.
S. Cote et al.; Ease of Donning Commercially Available Latex Examination Gloves, Publication; 1998, pp. 331-337, 7 pages; John Wiley & Sons, Inc.
T.T. Manson et al.; A New Glove Puncture Detection System ; Publication; The Journal of Emergency Medicine, 1995, pp. 357-364, 8 pages; vol. 13, No. 3, Elsevier Science Ltd.
Medina-Torres et al.; Rheological properties of the mucilage gum (*Opuntia ficus indica*), Publication, Food Hydrocolloids 14, 2000, pp. 417-424, 8 pages; Elsevier Science Ltd.
Fisher, M.D. et al.; Ease of Donning Commercially Available Powder-Free Surgical Gloves, Publication; 1996, pp. 291-295, 5 pages; John Wiley & Sons, Inc.
Paulsen et al.; Water-Soluble Polysaccharides of *Opuntia ficus-indica* CV "Burbank's Spineless", Publication; Phytochemistry, 1979, pp. 569-571, 3 pages; vol. 18, Pergamon Press, England.
D. McGarvie et al.; The Acid-Labile, Peripheral Chains of the Micilage of *Opuntia ficus-indica*, Publication; Carbohydrate Research, 1981, pp. 57-65, 9 pages; vol. 94, Elsevier Scientific Publishing Company, Amsterdam, Netherlands.
Saag et al.; Cactaceae Micilage Composition, Publication; J. Sci. Fd. Agric., 1975, pp. 993-1000, 8 pages; vol. 26.
Amin et al.; The mucilage of *Opuntia ficus-indica* Mill., Publication; Carbohyd. Res., 1970, pp. 159-161, 3 pages; vol. 15, Elsevier Publishing Company, Amsterdam, Netherlands.
Parikh et al.; Cholla Gum, I. Structure of the Degraded Cholla Gum, Publication; Canadian Journal of Chemistry, 1966, pp. 327-333, 7 pages; vol. 44.
Parikh et al.; Cholla Gum, II. Structure of the Undergraded Cholla Gum, Publication; Canadian Journal of Chemistry, 1966, pp. 1531-1539, 9 pages, vol. 44.
Lahsasni et al.; Moisture adsorption-desorption isotherms of prickly pear cladode (*Opuntia ficus* indica) at different temperatures, Publication; Energy Conversion and Management, 2002, pp. 1-14, 14 pages, Elsevier Science Ltd.
Quantachrome Hydrosorb™ 1000—Water Vapor Sorption Analyzer— www.quantachrome.com/Hydrosorb.b1. (Feb. 3, 2003), Quantachrome Instruments, Boynton Beach, FL; 3 pages.
http://www.ifl-online.com/preview/hi_preview.htmf, (Feb. 14, 2003), Hi Europe Preview, Adumin Food Ingredients, 1 page.
http://www.adumim.co.il/. (Feb. 14, 2003), "Fenu Pure", Israel, 3 pages.
http://www.matimop.org.il/newrdinf/company/c111.htm (Feb. 14, 2003), Adumin Food Ingredients (Chemicals) Ltd., 3 pages.
www.voigtglobal.com/index.html, Voigt Global Distribution, (Feb. 19, 2003), pp. 1-3.
www.plthomas.com, (Jan. 27, 2003), pp. 1-22, P.L. Thomas & Co, Inc.
http://my.ecplaza.net/xingdachem, (Jan. 27, 2003).pp. 1-3, Xiamen Xing Da Chemicals.
http:\\www.natunola,com/extracts.htm; (Mar. 25, 2003).
http://www.nhklabs.com/live/botanicals_extracts01 htm, NHK Laboratories, (Dec. 16, 2002), pp. 1-5.
http://www.aloecorp.com/products.html—Aloecorp List of Products, (Dec. 16, 2002), pp. 1-2.
www.glucomannan.com, (Jan. 28, 2003), Glucomannan Natural Soluble Fiber, pp. 1-2.
www.cognis.com. (Jan. 27, 2003), pp. 1-8, Cognis Homepage.
http://www.herbamed.co.11/prostl.html, Copyright 1997.
M.L. Phillips et al., "What is "powder free"? Characterization of powder aerosol produced during simulated use of powdered and powder free latex gloves" Occup. Environ Med 2001; 58: 479-81.
Swanson et al. J Allergy Clin. Immunol; 2002, vol. 110. No. 2, pp. S15-S20.
Swanson et al., J. Allergy Clin Immundl 1994, vol. 94, No. 3, Part 1, pp. 445-451.
www.pangaeasciences.com, (Jan. 27, 2003), pp. 1-10, Pangaea Sciences.

* cited by examiner

GLOVES CONTAINING DRY POWDERED ALOE AND METHOD OF MANUFACTURING

BACKGROUND OF THE INVENTION

Field of the Invention

The present invention relates generally to an article, namely a flexible impermeable elastomer glove, and method of making the same in which the glove contains a water-soluble detackifier and donning lubricant powder. More particularly, the invention relates to applying dry powdered Aloe and/or dry powdered Nopal to a dry wearer-contacting surface of a dried glove, and the invention relates to the glove containing the dry powdered Aloe and/or dry powdered Nopal having been so applied.

As is known in the art, flexible impermeable elastomer gloves include disposable gloves and reusable gloves. The aforementioned gloves (as well as other flexible elastomer articles) are thin, flexible, fluid impermeable, and are manufactured from a variety of polymeric materials herein throughout referred to as "elastomer(s)" or "elastomer material(s)". These elastomers may be considered a natural rubber as with natural rubber latex (NRL) or a synthetic rubber, or a plastic and include, but are not limited to, a synthetic polyisoprene, a chloroprene (including Neoprene-homopolymer of the conjugated diene chloroprene), a polyurethane (PU), a polyvinyl chloride (PVC), a styrene butadiene styrene (SBS), a styrene isoprene styrene (SIS), a silicone, a butadiene methylmethacrylate, an acrylonitrile, a styrene ethylene butylene styrene (SEBS), an acrylate-based hydrogel, any other elastomer that can be suspended into an emulsion, any other elastomer that is suspendable, soluble or miscible in a solution or plastisol, and combinations thereof.

As is also known in the art, disposable gloves (and reusable gloves) are manufactured of elastomer(s) in a single layer or in multi-layers where any given layer has a single or blended (or mixture of) elastomer material therein. The glove has a non-wearer-contacting surface (also herein throughout, "an outer surface" or "outside surface" or "distal surface" or "exterior surface") and an opposite wearer-contacting surface with one or more layers of single or blended mixtures of elastomer material therein. Elastomer gloves tend to be sticky or tacky, difficult to don and tend to trap hand perspiration.

Disposable gloves are widely used by members of the medical community, the scientific community, and the industrial community to protect the wearer from chemical exposure, mechanical abrasion, environmental hazards, biohazard contamination and to prevent transmission of disease or contaminants. Health care providers frequently wear disposable gloves while performing surgery or other medical or dental procedures such as patient examinations; thus, the gloves are often also referred to as disposable examination gloves or disposable surgical gloves. The disposable gloves are impermeable to biological fluids, tissues and solids produced by the body or other contaminants (human or animal) advantageously protecting the wearer from fomitic (transmission by objects that harbor pathogenic organisms) transmission of pathogens and disease.

Also, disposable gloves are worn by individuals who wish to protect their hands from various chemicals, materials and objects which may irritate, damage or dry out the user's skin and which may be harmful or potentially harmful if allowed to contact or permeate the dermal barrier. Scientists, cleaning service workers, food handlers, law enforcement workers, beauticians or other workers having special protection needs, may wear these gloves in the occupational setting. Thus, disposable gloves may also be referred to as protective gloves or industrial gloves. Also, some disposable gloves, for example household gloves or gardening gloves, are considered reusable gloves because they can be used multiple times prior to disposal.

Flexible elastomer articles, like disposable gloves, are frequently changed by the wearer during the day between patients or between procedures or activities. Allergy and irritation potential of a finished disposable glove has been exacerbated by common glove manufacturing practices of using vulcanizing accelerators, antioxidants, certain powders and other additives as a means to speed production, ease donnability, prevent tackiness and enhance durability during the storage and useful life of the glove. In addition, since disposable gloves cover the hand, moisture (perspiration) is trapped beneath the glove, contributing to hand dermatitis. In excess of 20% of healthcare providers struggle with an allergic or irritant contact dermatitis or the IgE mediated latex hypersensitivity (Type I) thereby making these individuals more susceptible to infection.

Although many glove users apply lotions and creams to moisturize their hands, these emollients frequently are oil-based which deleteriously affect an NRL glove. Further, these creams and lotions often contain similar antigenic chemicals and serve to exacerbate the skin problems.

The art has responded to the tackiness and donning problems of elastomer gloves in a number of ways. See Applicant's co-pending application Ser. Nos. 10/373,970 filed on Feb. 25, 2003, Ser. No. 10/373,985 filed on Feb. 25, 2003, and 60/425,075 filed on Nov. 7, 2002, each of which are incorporated herein by reference. One solution to the aforementioned problems is treating the glove with certain powders (e.g., cornstarch, oat starch, talcum (talc) powder, other starch dusting powders, polyglycolic acid powder, insoluble sodium metaphosphate powder, magnesium carbonate, oat starch and granular vinyl chloride polymer). Commonly cornstarch powder is used inside the glove because most elastomers are inherently sticky on their surfaces causing a blocking effect, which makes it difficult to don the glove without the powder. The aforementioned powder(s) may provide comfort to the wearer's hand as the hand moisture builds up within the glove as the glove is used but conversely may also act to dry, abrade and irritate the user's skin.

It has also been shown that the NRL antigenic proteins bloom to the surface of a disposable NRL glove (or other flexible article) and migrate into cornstarch powder particles (typically used to make the NRL glove easier to don), which then serve as vehicles to carry the antigen. This has been shown to be most problematic as an aerosolized particle delivered during breathing to the immunoactive tissue of the nasopharynx and bronchial tree. This occurs because macrophages and specialized T cells and B cells are concentrated in the tissue of the nasopharynx and bronchial tree and they become sensitized and produce IgE specific antibodies, which recognize the NRL antigens, carried by the cornstarch. Thus, cornstarch powder used in NRL gloves can cause systemic NRL allergies, skin irritation and exacerbate contact allergies.

Another problem with the use of certain powders, e.g., talc and cornstarch in surgical gloves is the concern about adhesion formation in the patient's surgical site. This is a particularly significant problem as an intraperitoneal postoperative complication where adhesions of the bowel cause significant sequellae in some patients. Surgeons are provided with towels after donning surgical gloves to remove as much of the powder as possible. However, they are not completely successful. The powder particles are responsible for the irritation producing the scarring responsible for the adhesions. The adhesions are caused by mechanical irritation of the tissue when the powder particles are sequestered in the surgical site. This complication has lead the way in the evolution of surgical gloves from powdered with talc to powdered with absorbable cornstarch and now to powder free gloves.

Balanced against the disadvantages of using surface powders such as talc, cornstarch, and oat starch, is the advantage that the surface powders assist in the mitigation of the inherent tackiness of most elastomers. In order to detackify the non-wearer-contacting surface of the elastomer glove, powder needs to be applied there as well. This occurs as a part of normal processing of a glove disposed on a former to which powder is applied to the wearer-contacting surface. These gloves are typically stripped and then sent to a tumbler in order to remove any excess powder and to evenly distribute the powder. Powder, particularly in the cuff area of the hand wearer-contacting surface, is partially dislodged and contributes to the powdering of the outer surface of the glove during tumbling. Thus, there is powder on both sides of the glove. Typically, more powder is disposed on the inside of the glove than on the outside of the glove. The powder inside the glove prevents the glove from sticking to itself and aids in improved donning. The powder disposed on the outside surface of the glove (non-wearer-contacting surface) prevents gloves from sticking to each other. Thus, the surface powders when acting as detackifiers reduce the tendency of the gloves to stick to themselves on the inside and to stick to each other when tightly packed together in typical glove dispensers.

Also, the use of a powdered donning lubricant such as talc, cornstarch, and oat starch is preferred by many glove users, even over lubricant coatings applied to the wearer-contacting surface of the glove or to powderless gloves. The powdered donning lubricants reduce the frictional forces that must be overcome when the glove is put on.

Still others have used halogenation (chlorination) and neutralization to solve the tackiness and donning problems of elastomer gloves. Yet, others have used other surface treatments (for example, powderless gloves using alternative lubricants, such as, silicone treated gloves, and polyurethane treated gloves) to solve the aforementioned problems. The surface treatments include coatings applied to the wearer-contacting surface (interior) of a glove. A coating is a material that provides an additional layer on the inside of the glove. Coating the gloves with alternative lubricants (glove coatings) present challenges because coatings are difficult to apply to a glove with a dip, spray, spray and tumble (spray/tumble), or soaking process (commonly used processes in glove manufacturing). When the gloves are still on a glove former, because of the relative hydrophobicity of the surface of most gloves, the coatings tend to bead and concentrate in dependent areas of the glove resulting in uneven application of the coating.

Some have recognized the benefits of Aloe in or as a coating for a glove. It is believed that Aloe contains active biological ingredients. Aloe is a plant, long looked to in folk medicine for skin care and has been used in skin care products for moisturizing the upper layers of the epidermis of the skin. (See U.S. Pat. No. 5,800,818 to Prugnaud et al.) The use of Aloe incorporated into porous therapeutic gloves is known. (See U.S. Pat. No. 5,869,072 to Berry where Aloe vera is used in a mixture of water and polyvinyl alcohol, which is evaporated onto a porous flexible sheet). Also, the incorporation of Aloe vera into a layer of an elastomeric article is known, as is coating the elastomeric article with one or two layers of Aloe extract solution. (See, U.S. Patent Application Publication, US 2002/0114825 A1 and U.S. Pat. No. 6,589,544 B2 to Leong.) Others have used coatings of a liquid solution of Aloe vera applied to the interior of the glove by dehydration of the liquid solution (U.S. Pat. No. 6,274,154 and U.S. Pat. No. 6,423,328, both to Chou and both incorporated herein by reference, U.S. Patent Application Publication No. 2001/0048937 A1, U.S. Patent Application Publication No. 2002/0025335 A1, U.S. Patent Application Publication No. 2002/0110584 A1, and U.S. Patent Publication No. 2003/0017193A1, all to Chou and all of which are incorporated herein by reference). The Chou method of manufacturing the gloves discloses the steps of: forming an NRL glove, turning the glove inside out, applying an aqueous solution of Aloe vera to the surface facing out, removing the liquid from the aqueous solution of Aloe vera by a controlled dehydration process with heat tumble drying of the gloves and/or the use of forced heated air to provide a partially and preferably full or at least substantial dehydration of the Aloe vera solution in the gloves, and turning the glove right side out so the dehydrated coating of Aloe vera contacts the hand of the glove wearer. When the gloves are worn, the moisture from the wearer's hand dissolves the Aloe vera coating.

Despite the advantages of using Aloe as a coating material, for glove manufacturers competing in the international glove industry, the costs in material, time, labor, and additional equipment for dehydrating a liquid coating of the Aloe becomes an important consideration in competing globally, considering the demand in the marketplace for gloves having Aloe therein.

Some have recognized the benefits of Nopal in folk medicine. Others have shown Nopal contains compounds e.g., active biological ingredients or therapeutically important molecules, with a range of therapeutically relevant physiological activity including moisturizing, anti-microbial, wound healing, anti-inflammation, analgesia and anti-aging properties. (See Ahmad, Antiviral Research 30 (1996) 75-85; Park et al., Filoterapia 72 (2001) 288-290; Loro et al., Journal of Ethnopharmacology 67 (1999) 213-218; Park et al., Filoterapia 72 (2001) 165-176; U.S. Pat. No. 6,447,820, to Niazi; Park et al., Archives of Pharmacal Research, Vol. 21, Issue 1, February 1998, Abstract-Medline; Budinsky et al., Prostaglandins, Leukotrienes and Essential Fatty Acids (2001), 65(1), 45-50; U.S. Pat. No. 6,099,866, to Slimak; U.S. Pat. No. 5,800,818 to Prugnaud et al.; and U.S. Patent Application Publication No. 2002/0102317, to Gutterrez et al., all of which are incorporated herein by reference.) Also, see Par. [0092] of Applicant's co-pending application Ser. Nos. 10/373,970 and 10/373,985 which are incorporated herein by reference.

Applicant has discovered the benefits of using Nopal in one or more layers of a glove and using Nopal as a coating for a glove (see, applicant's co-pending patent application Ser. Nos. 10/373,970 and 10/373,985 and provisional patent application 60/425,075, the disclosures of which are incorporated herein by reference). Applicant has recognized the superior donning lubricant qualities of Nopal, has also recognized the economic advantages of using Nopal over Aloe, and has recognized Nopal's improved ability to absorb hand perspiration beneath the glove (improved water homeostasis over Aloe, cornstarch, silicone and polyurethane). (See Applicant's co-pending patent applications, supra.)

It is desirable that gloves (disposable and/or reusable) provide the necessary protection, are durable, flexible, do not cause irritation or allergy problems to those in contact with the article, are not tacky, are easy to don, and are comfortable to wear.

Accordingly, if a material could be chosen for application to a glove surface (or other flexible article surface) using a non-coating method which material produces acceptable donning attributes without the need for cornstarch as a donning agent, the transmission of the NRL antigenic protein would be minimized. If the material could also act as a detackifier, a contribution would be made by mitigating the inherent tackiness of the elastomer gloves reducing the tendency of the gloves to stick together to themselves on the inside and to each other when tightly packed together in typical containers. If the material is also a water-soluble powder, then the problem of scarring and adhesion formation would be lessened for the patient, as the powder particles from the surgeon's gloves would dissolve upon contact with body fluids such as blood. If the material could also simultaneously optimize moisture homeostasis between the glove and epidermis of the wearer to minimize irritant contact dermatitis from the extremes of dryness and wetness, a contribution would be made in reducing the risk of infection of damaged skin. If said material also partially solubilizes during use and delivers therapeutically important molecules to mitigate the risks of irritant and contact dermatitis, the user will benefit from added protection. If the material also functions as a microbicide, an additional important level of protection could be provided if the glove were to fail and skin exposure to a pathogen occurred. Furthermore, if said material also functions as a delivery vehicle for certain additive(s), an important contribution to delivery of the additive(s) to the skin of the user may be made. If said material could be applied to the glove without heat, the amount of therapeutically important molecules on the wearer-contacting surface of the glove would be maximized since the said molecules would not be deactivated by heat.

A need exists to provide a flexible elastomer glove with improved moisturizing properties, lubricity and donning characteristics, and which provides comfort to the wearer, which can be produced in an economical manner to meet the needs of the global marketplace.

A need also exists to provide a more economical method of fabricating a flexible elastomer glove with improved lubricity and donning characteristics and with improved water absorption characteristics.

SUMMARY OF THE INVENTION

The needs, disadvantages and limitations of the background art discussed above are overcome by the present invention.

The present invention in one of its aspects provides a flexible impermeable elastomer glove containing a water-soluble detackifier and donning lubricant powder namely, a dry powdered material, preferably a dry powdered Aloe and/or a dry powdered Nopal. The dry powdered material is applied by aerosol application to, electrostatic application to, by tumbling with, or in other ways known in the art, to a dry wearer-contacting surface of a dried glove. The dry powdered Aloe and/or dry powdered Nopal powder may be combined with dry additive(s), such that the dry powdered Aloe and/or dry powdered Nopal serve as a delivery vehicle for the dry additive(s). The dry powdered material serves as a delivery vehicle for delivery of dry additives to the interior of the glove, and acts as a donning lubricant, and as a water absorption material. It is an advantage of the present invention that the dry powdered material when so applied, quickly acts to lubricate the user's skin to improve user comfort and to improve the donning characteristics of the glove. Advantageously, the glove, having the dry powdered material applied thereon, may be either a single layer glove, or a multi-layer glove, including a bilaminar glove.

In a second aspect of the present invention, a method of making a flexible elastomer glove is provided in which the dry powdered material (the dry powdered Aloe and/or dry powdered Nopal) with or without dry additive(s) is applied onto a dry wearer-contacting surface of a dry glove. Advantageously, the method does not require the application of and drying of an aqueous coating of an Aloe solution and/or of a Nopal solution, thereby saving cost in time, labor, equipment and energy and providing a competitive edge in the global market place.

In yet a third aspect of the present invention, a method of applying a dry powdered material (dry powdered Aloe powder and/or dry powdered Nopal powder) with or without dry additive(s) to a dry wearer-contacting surface of a dry glove is provided. The dry powdered Aloe and/or dry powdered Nopal is applied by electrostatic application onto, or by tumbling the dry powdered material with or by aerosolizing the powder onto, the dry wearer contacting surface of a dry glove or by application of the powder onto the dry wearer-contacting surface of the glove from a fluidized bed or a non-fluidized bed of the dry powdered material with or without additives prior to stripping the glove from a glove former. This method does not require a heating step for the application process. Advantageously, this provides a simple and cheaper application method than using a method that requires heat drying an aqueous coating of Aloe and/or an aqueous coating of Nopal. The method of application provides a more economical glove to meet the consumer demand for a glove having Aloe therein. Advantageously, since the method of application does not require a heating step to apply the dry powdered material to the glove, therapeutically important molecules in the dry powdered material are not deactivated by a heating step.

Finally, it is an objective that all of the aforesaid advantages be achieved without incurring any substantial relative disadvantage and with achieving cost savings.

Other advantages and features of the invention, together with the organization and manner of operation thereof, will become apparent from the following detailed description when taken in conjunction with the accompanying drawings wherein like elements have like numerals throughout the drawings. It is expressly understood that the drawings are for the purpose of illustration and description only, and are not intended as a definition of the limits of the invention.

DESCRIPTION OF THE DRAWINGS

These and other advantages of the present invention are best understood with reference to the drawings, in which.

DETAILED DESCRIPTION OF THE PREFERRED EMBODIMENT

Referring particularly to FIG. 1-4, wherein like numbers refer to similar parts, a flexible impermeable elastomer glove in which a glove contains a water soluble detackifier and donning lubricant powder which is applied as a dry powdered material to a dry wearer-contacting surface of the glove, a method of making the glove, and a method of applying the dry powdered material to a dry wearer-contacting surface of the glove are disclosed in accordance with the present invention. The dry powdered material of the present invention is dry powdered Aloe and/or dry powdered Nopal. The dry powdered Aloe and/or dry powdered Nopal used in the present invention are sufficiently dry such that they cannot be dehydrated onto the glove of the present invention.

The botanical sources of Aloe are typically from, but are not limited to, the Aloe vera and Aloe barbadensis and other species of the Aloe plant. Hereinthroughout, the term "Aloe" includes the named species Aloe vera and Aloe barbadensis and other species of the Aloe plant, as is known in the art. The botanical sources of Nopal (a.k.a. Cholla and Prickly Pear Cacti) are typically from, but are not limited to, any species of the Opuntia, Nopalea and Consolea genera (subfamily Opuntioideae), for example, but not limited to, Opuntia ficus indica, Opuntia dillenii, Opuntia streptacantha, Opuntia engelmanii, Opuntia fulgida, Opuntia fulginosa, Nopalea auberi, Nopalea karwinskiana, Consolea rubescens and Consolea monoliformis. Hereinthroughout, the term "Nopal" includes the aforementioned named species and any other species of the Nopal plant, as is known in the art. Preferably, Nopal is made from the cladodes (pads) of the Opuntioideae plant(s). The dry powdered Aloe is Aloe powder commercially available as a freeze-dried powder or a dehydrated powder. The dry powdered Nopal is commercially available as a freeze-dried powder or a dehydrated powder. Commercial sources of the dry powdered material of the present invention are available, for example, from Aloe Laboratories, Harlingen, Tex., USA and NHK Laboratories.

Figure 1:
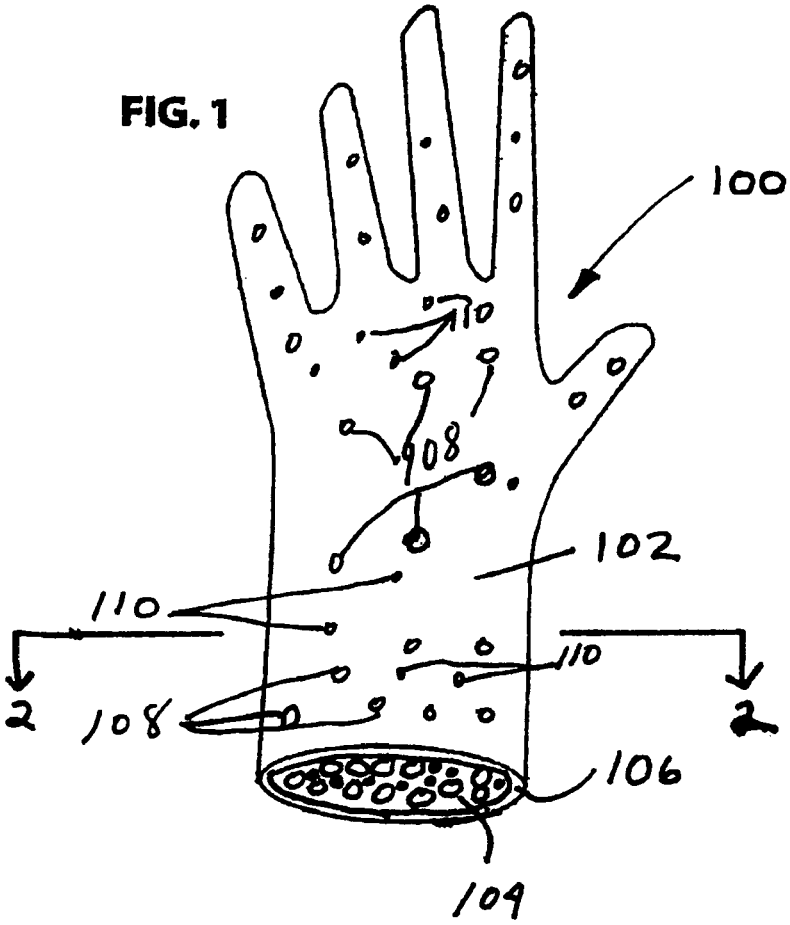
FIG. 1 is a perspective view of a glove of the present invention showing an outer surface and an inner or wearer-contacting surface.
Figure 2:
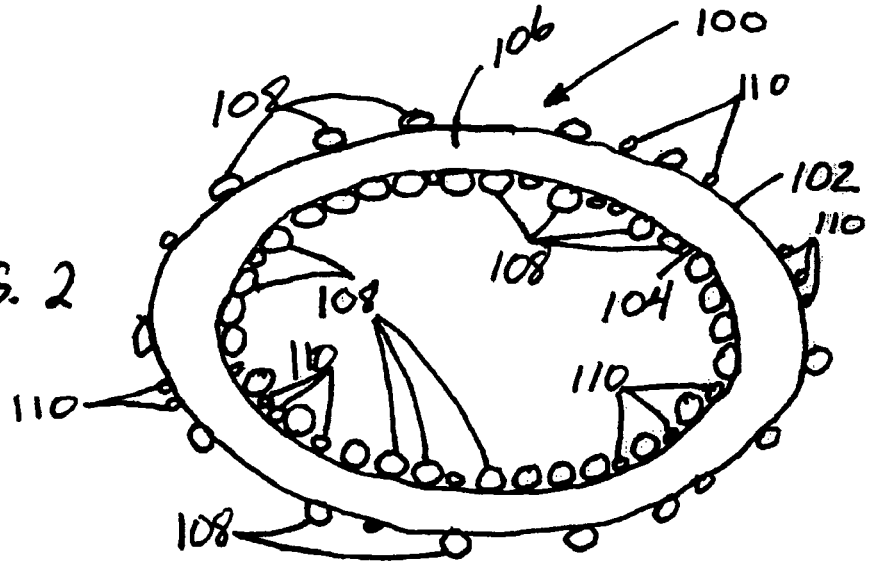
FIG. 2 is a cross sectional view taken through lines 2-2 of a portion of the dry wearer contacting surface of the glove of FIG. 1 having a dry powdered material of the present invention thereon.

Referring now to FIGS. 1 and 2, a flexible impermeable elastomer glove in accordance with the present invention is designated generally as 100. As shown in FIGS. 1 and 2, the glove 100 has an outer surface (non-wearer-contacting surface) 102 and an inner or wearer-contacting surface 104 and elastomer(s) 106 therebetween. The elastomer(s) 106 may include one or more layers of elastomer or blended elastomers, as disclosed supra, which are incorporated herein by reference. As best shown in FIG. 2, the wearer-contacting surface 104 has a dry powdered material 108 applied thereon. The dry powdered material 108 is dry powdered Aloe and/or dry powdered Nopal, as disclosed supra. FIGS. 1 and 2 are not drawn to scale, nor is the dry powdered material 108 (with or without an additive 110) drawn to scale. The glove 100 is made according to a method disclosed in FIG. 3. The dry powdered material 108 is applied to a dry flexible elastomer glove according to a method disclosed in FIG. 4.

The percentage concentration per hundred weight of elastomer (or phr) in glove 100 of the present invention of dry powdered material 108 ranges from about 0.001 to about 5.0 weight of dry powdered Aloe and/or dry powdered Nopal per 100 weight of elastomer(s) (e.g., 0.001-5.0 phr), but preferably the phr of the dry powdered material 108 is about 0.2 to about 2.5 phr. The phr range may be extended depending on the type of glove made and proprietary process nuances. Certain gloves may require about 25 phr or greater of the dry powdered material 108. For a batch of 8,000 to 10,000 examination gloves preferably 2 kilograms of dry powdered material 108 is used. The phr for the dry powdered material 108 may also be determined by industry standards or guidelines, such as the IASC (International Aloe Science Council certification criterion for residual Aloe in a finished article containing aloe, and ASTM Standards D 3578-01a$^{\epsilon 2}$ and D 6124-01 (available from ASTM International West Conshohocken, Pa. 19428-2959, United States) for gloves; all three disclosures are incorporated herein by reference. The dry powdered material 108 serves as a moisture regulator, a lubricant, a donning agent, and imparts a range of therapeutic benefits and comfort to the wearer. It is an advantage of the present invention that the dry powdered material 108, when applied according to the method of the present invention, as opposed to a coating layer, acts more quickly to lubricate the user's skin to improve user comfort and donning characteristics of the glove, because a layer of coating does not need to be dissolved by the perspiration from the user's hand. It is an advantage of the present invention that any particles of the dry powdered material on the exterior of the gloves will dissolve in a patient's moist mucosa or surgical site, thereby lessening the development of scarring and adhesions. It is another advantage that the method of application does not require a heating step to apply the dry powdered material 108 to the glove; thus the therapeutically important molecules in the dry powdered material 108 are not deactivated by a heating step. Thus, more of the therapeutically important molecules of the dry powdered material 108 are available from the glove 100 as compared to a glove made according to an application process using heat, such as coating and dehydrating a solution of Aloe and/or Nopal, for an equivalent amount of Nopal and/or Aloe in the finished glove. In the global economy this can create a competitive edge in the market. The glove 100 of the present invention, having the dry powdered material 108 applied thereon, may be either a single layer glove, or a multi-layer glove, including a bilaminar glove.

The dry powdered material 108 (dry powdered Aloe and/or the dry powdered Nopal) may be fortified by commercially available dry additive(s) known to protect and restore mammalian skin. The dry additive(s) 110 may be added in usual amounts to meet content labeling requirements known in the industry. Specific examples of suitable dry additives to the dry powdered material 108 include one or more of dry Vitamin A, Vitamin E, Vitamin C, Vitamin $B_3$, Vitamin $B_5$, jojoba, rose hips, dried tea tree oil, dried flax seed oil, dried palm oil, and acetylsalicylic acid. Preferably the glove 100 of the present invention has within it, dry powdered Aloe and/or dry powdered Nopal, and at least one dry additive of Vitamin E, Vitamin A, Vitamin C, or Vitamin D; most preferably in that order of preference. Most preferably Vitamin E is selected as the dry additive 110. Most advantageously the dry powdered Aloe and/or dry powdered Nopal function as a delivery agent for the dry additive 110, maximizing the bioavailability of the dry additive 110.

Hand sweating beneath a glove with chronic use is known to be a contributor to irritant contact dermatitis, see supra. Most advantageously, Nopal and Aloe provide superior water absorption properties over cornstarch, silicone and polyurethane which are used as common donning agents (see T 121-132, FIGS. 25-31 of Applicant's co-pending application Ser. Nos. 10/373,970 and 10/373,985 which are incorporated by reference herein). The ability to reversibly absorb the perspiration without the abrasive properties of cornstarch is an advantage over the prior art. The improvement of moisturizing characteristics is a function of the water homeostasis of the dry powder material 108 after the glove 100 is donned.

Alternatively, as may be appreciated by those skilled in the art, other dry powdered materials may be used instead or in combination with dry powdered Aloe and/or dry powdered Nopal; these materials include one or more dry powdered plants including okra, and/or kelp, and/or tamarind, and/or psyllium, and/or carrageenan, and/or chia, and/or flax, and/or carob, and/or guar, and/or xanthan, and/or konjac, and/or cassia, and/or tara, and/or karaya, and/or ghatti, and/or tragacanth, and/or glucomannan, and/or galactomannan. The dry powdered materials are commercially available, for example, from NHK Laboratories; Aloe Laboratories Harlingen, Tex., U.S.A.; Voigt Global Distribution; Natunola Health, Nepean, Ontario Canada; P. L. Thomas; Xiamen Xing Da Chemicals; Konjac Foods USA, Cupertino, Calif., U.S.A.; Pangaea sciences; purified galactomannan (Fenu-Pure from NatuR&D, the Nutraceuticals Division of Adumim Food Ingredients, Industrial Zone, Mishor Adumim, Israel).

Alternatively as appreciated by those skilled in the art, the dry powdered materials 108 (Aloe and/or the dry powdered Nopal) with or without the dry additive(s) 110 (and the alternative dry powdered plants) described previously herein may be applied to any flexible elastomer article (not necessarily just the glove 100 of the present invention) having at least one elastomer layer and having a wearer-contacting surface and a distal surface disposed distal to the wearer-contacting surface using the method of the present invention. Preferably another flexible elastomer article to which the dry powdered Aloe and/or dry powdered Nopal (with or without the dry additives) may be applied includes a condom.

Figure 3:
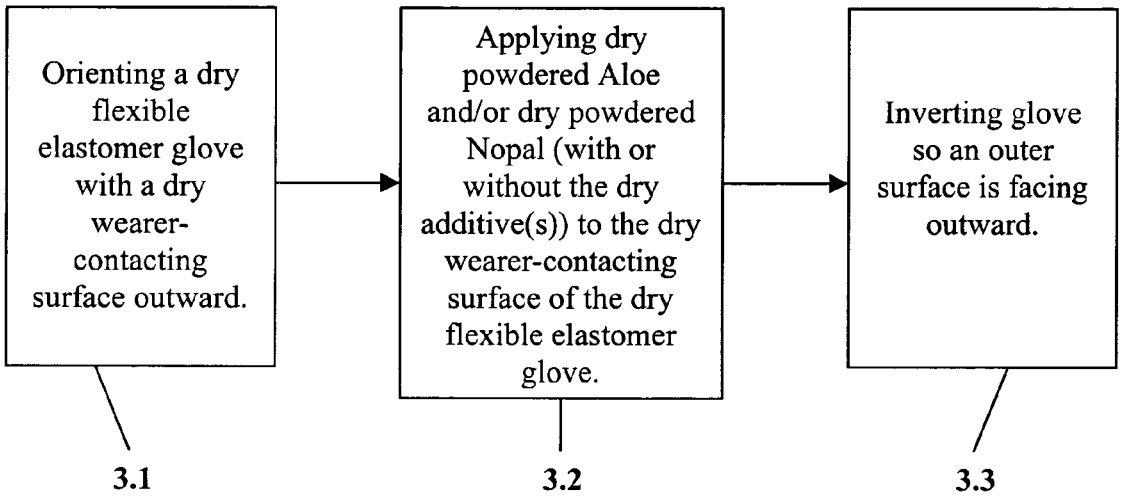
FIG. 3 is a schematic flow diagram showing a method for making a glove of the present invention.

As best shown in FIG. 3, a method of making the flexible elastomer glove 100 is illustrated. In Step 3.1, a dry flexible elastomer glove, made according to standard glove manufacturing processes, having a dry wearer-contacting surface is oriented to receive a dry powdered material 108 applied to the wearer-contacting surface. Usually the wearer-contacting surface is positioned outwardly. In Step 3.2, dry powdered material 108 (dry powdered Aloe and/or dry powdered Nopal) with or without the aforementioned dry additives 110 is applied to the dry wearer-contacting surface of the dry flexible elastomer glove without the application of heat. In Step 3.3, the glove 100 of the present invention is inverted to have the outer surface non-wearer-contacting surface 102 facing outward (the wearer contacting surface 104 inside the glove 100) as shown in FIG. 1. The glove 100 may then be further processed, according to known in the art, glove finishing processes that do not require the addition of moisture or that preferably do not require the application of heat to the glove 100. Such further processing is described in Par. [0011] supra, causing the dry powdered material 108 (with or without the additive 110) to be deposited on the non-wearer contacting surface 102 of glove 100, providing the detackifier properties to the outside 102 of the glove 100.

As is appreciated by those skilled in the art, any flexible elastomer article may be produced according to the same method. A dry elastomer article is made according to known in the art techniques and is preferably oriented with the wearer surface facing outside. The dry powdered material 108 (dry powdered Aloe and/or dry powder Nopal) with or without dry additive(s) 110 is applied to the dry wearer-contacting surface of the dry elastomer article. The article is inverted and may undergo further tumbling processing as described for gloves as in Par. [0011], supra. For certain articles such as condoms, the dry powdered Aloe and/or dry powdered Nopal (with or without dry additive(s) 110) may be applied in this manner.

As noted supra, the amount of the dry powdered Aloe and/or dry powdered Nopal used in the method of the present invention is in a quantity sufficient to be able to meet industry standards or guidelines, such as, but not limited to, the IASC criteria for residual Aloe in the article and the aforementioned ASTM standards. The phr of the glove 100 of the present invention of dry powdered Aloe and/or dry powdered Nopal ranges from 0.001 to 5.0 weight of dry powdered Aloe and/or dry powdered Nopal per 100 weight of elastomer(s), preferably about 0.2 to about 2.5 phr.

Advantageously the method does not require the application and drying of an aqueous coating of an Aloe solution and/or a Nopal solution, nor does it require separate application or dehydration of an aqueous additive coating material, thereby saving cost in time, labor, equipment and energy and providing a competitive edge in the global market place. Furthermore, for equivalent amounts of Aloe and/or Nopal in the finished article, because heat is not used to evaporate moisture or solvents or to dehydrate a coating material onto an article, greater amounts of the therapeutically important molecules in the dry powdered material 108 are available in and on the glove 100 since the therapeutically important molecules are not deactivated by a heating step.

Figure 4:
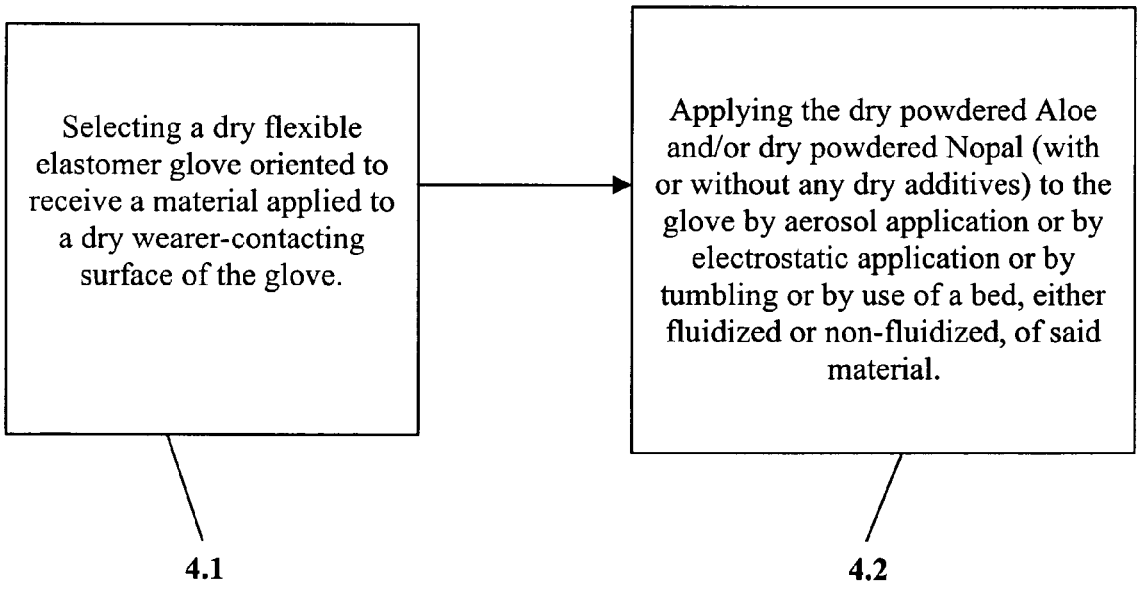
FIG. 4 is a schematic flow diagram showing a method for applying the dry powdered material of the present invention to the dry wearer-contacting surface of a dry glove.

Referring now to FIG. 4, a method of applying the dry powdered Aloe and/or dry powdered Nopal (with or without the dry additive(s) 110) to a dry wearer contacting surface of a dry flexible elastomer glove includes a Step 4.1 of selecting a dry flexible elastomer glove oriented to receive a material to be applied to a dry wearer contacting surface of the glove. In Step 4.2, the dry powdered material 108 (the dry powdered Aloe and/or dry powdered Nopal) with or without the dry additive(s) 110 is applied to the dry wearer-contacting surface of the glove by applying the dry powdered material 108 (with or without dry additive(s) 110), to the dry wearer-contacting surface, by aerosol application, by electrostatic application, by tumbling, or by use of a bed, either fluidized or non-fluidized of the dry powdered material 108, but preferably by aerosol application.

The dry powdered material 108 (with or without the dry additive(s) 110) is aerosolized using pressurized nozzles disposed in a negative pressure chamber through which the dry gloves still on formers pass. The dry powdered material 108 adheres to the surface of the elastomer (polymer) material of the glove because of the inherent tackiness of the elastomer material. The dry powdered material 108 (with or without the dry additive(s) 110) is in a fine cloud form having a particle size preferably about 14 microns or less. Advantageously, the smaller the particle size used, the greater the wearer perceives improved lubricity in donning the glove 100, as the aforementioned sized particles can move more easily on the wearer-contacting surface 104 of the glove 100 as the glove 100 is donned by the wearer. The quantity of dry powdered material 108 deposited is proportional to the aerosolized concentration of the dry powdered material 108 in the negative pressure chamber and the length of time in the chamber. Preferably for 8,000-10,000 gloves, about 2 kilograms of the dry powdered material 108 is used. The glove 100 is inverted as it is pulled from the former.

Alternatively, the dry powdered Aloe and or the dry powdered Nopal (with or without the dry additive(s) 110) may be electrostaticly applied to a dry wearer-contacting surface of a dry glove. A completely dry inverted glove is disposed on a glove former. An electrostatic charge is applied to the glove former wherein there is a difference in charge between the former and the glove surface. The electrostatic charge creates a static charge difference between the wearer-contacting surface of the glove and the dry powdered material 108 (with or without the dry additive(s) 110). The dry powdered material 108 (with or without the dry additive(s) 110) is applied in aerosol form (supra), as an aerosolized dry powder, to the glove while the glove is on the former. The charge difference attracts the aerosolized powder to the wearer-contacting surface of the glove. And the electrostatic charge between the former and the wearer-contacting surface of the glove produces a more uniform deposition of the dry powdered material 108 onto the wearer-contacting surface of the glove. Advantageously, there is less waste of the dry powdered material 108 (with or without the dry additive(s) 110), thereby reducing costs to gain a competitive edge in the global market and the process is far easier to manage in the factory manufacturing setting, thereby also yielding an economic advantage. Alternatively, rather than applying an aerosol form of the dry powdered material 108 (with or without the dry additive(s) 110), the glove is sprayed or dusted with the dry powdered material 108 (with or without the dry additive(s) 110) until the dry wearer-contacting surface of the glove is covered with the dry powdered Aloe and/or the dry powdered Nopal (with or without dry additive(s) 110). About 2 kilograms of the dry powdered material 108 to 8,000 to 10,000 gloves is used. The glove 100 is inverted as it is pulled from the former.

Alternatively, the dry powdered material 108, the dry powdered Aloe and/or dry powdered Nopal (with or without the dry additive(s) 110), is applied to the dry glove by tumbling the dry powdered material 108 with the dry glove in a tumbling chamber of a glove tumbler. As is known in the art, in some glove making processes, a glove is dried in a glove tumbler with the dry glove oriented in such a manner that the dry wearer contacting surface is facing outwardly. The dry powdered Aloe and dry powdered Nopal (with or without the dry additive(s) 110) are added to the glove tumbler; no additional heat is necessary to evaporate moisture or solvents. The dry powdered material 108 may be in an aerosol form as disclosed supra, or in a non-aerosol form when added to the tumbling chamber. The gloves are tumbled until the dry powdered Aloe and or the dry powdered Nopal (with or without dry additive(s) 110) cover the gloves for approximately 2-5 minutes for 8,000 to 10,000 gloves using approximately 2 kilograms of the dry powdered material 108. Alternatively, a dry glove is oriented in such a manner that the dry wearer contacting surface is facing outside (external) and is put into a glove tumbler with the dry powdered Aloe and dry powdered Nopal (with or without the dry additive(s) 110), and tumbled without applied heat until the dry powdered materials 108 (the dry powdered Aloe and or the dry powdered Nopal (with or without dry additives(s) 110)) cover the dry wearer contacting surface 104 of gloves 100, e.g., approximately 2-5 minutes for 8,000-10,000 gloves using about 2 kilograms of the dry powdered material 108. The gloves are inverted after tumbling so the non-wearer-contacting surface 102 is disposed outwardly as shown in FIG. 1. In the tumbling process, some of the dry powdered Aloe and dry powdered Nopal (with or without the dry additive(s) 110) will adhere to the non-wearer contacting surface 102.

Still yet alternatively, in a glove stripping station, a bed of the dry powdered material 108 (with or without additives (110)) is disposed beneath the gloves. The bed of the dry powdered material 108 (with or without additives (110)) may be non-fluidized or fluidized. A fluidized bed means that the dry powdered material 108 (with or without additives (110)) is aerated, e.g., air bubbles up through the dry powdered material 108 (with or without additives (110)). The hand strippers manually apply the dry powdered material 108 from the fluidized bed to the surface of the glove just before glove 100 is stripped from the former. Stripping inverts the glove 100. The amounts of the dry powdered material 108 are as described supra.

As appreciated by those skilled in the art, the method of application of the present invention may be used to apply the dry powdered Aloe and/or the dry powdered Nopal to other flexible elastomer articles, including condoms.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention and that the scope of the present invention be limited solely by the broadest interpretation that lawfully can be accorded the appended claims.

What is claimed is:

1. An article comprising a flexible impermeable elastomer glove having a dry wearer-contacting surface, a non-wearer-contacting surface and at least one layer of elastomer therebetween; and a dry powdered material applied in powder form to the dry wearer-contacting surface, wherein the dry powdered material is a water soluble detackifier and donning lubricant powder including dry powdered Aloe or dry powdered Nopal or both, wherein the dry powdered material is disposed only on the dry wearer-contacting surface of the glove and the at least one layer of elastomer between the dry wearer-contacting surface and the non-wearer-contacting surface is free of the dry powdered material.

2. The article of claim 1, wherein the dry powdered material is dry powdered Aloe.

3. The article of claim 1, wherein the dry powdered material is dry powdered Nopal.

4. The article of claim 1, wherein the dry powdered material is dry powdered Aloe and dry powdered Nopal.

5. The article of claim 1 wherein the dry powdered material acts as a donning lubricant for the glove, provides water absorption properties for the glove and provides a delivery vehicle for a dry additive.

6. The article of claim 1 further comprising a dry additive applied to the dry wearer-contacting surface, wherein the dry additive includes one or more of Vitamin E, Vitamin A, Vitamin C, and Vitamin D.

7. The article of claim 1, wherein the article is a disposable glove or a reusable glove.

8. The article of claim 1, wherein the article is a single layer elastomer glove or a multi-layer elastomer glove.

9. The article of claim 8, wherein any layer of the single layer elastomer glove or the multi-layer elastomer glove has a single elastomer therein or has a mixture of elastomers therein.

10. The article of claim 1, wherein the elastomer of the flexible impermeable elastomer glove includes one or more of a natural rubber latex or a synthetic rubber, or a plastic, or a synthetic polyisoprene, or a chloroprene, or polyurethane, or polyvinyl chloride, or a styrene butadiene styrene, or a styrene isoprene styrene, or a silicone, or a butadiene methylmethacrylate, or an acrylonitrile, or a styrene ethylene butylene styrene, or an acrylate-based hydrogel, or any other elastomer that can be suspended into an emulsion, or any other elastomer that is suspendable, soluble or miscible in a solution or plastisol.

11. The article of claim 1, wherein the flexible impermeable elastomer glove is a flexible impermeable natural rubber latex glove.

12. The article of claim 1, wherein the article contains about 0.001 to about 5.0 weight of dry powdered material per 100 weight of elastomer in the article.

13. The article of claim 1, wherein the article is made according to a method comprising:

(a) orienting a dry flexible impermeable elastomer glove having a dry wearer-contacting surface to receive the dry powdered material on the dry wearer-contacting surface;

(b) applying the dry powdered material, with or without a dry additive, to the dry wearer contacting surface; and (c) reorienting or inverting the article, if needed, to position the wearer-contacting surface inside the article.

14. The article of claim 13, wherein the article contains about 0.001 to about 5.0 weight of dry powdered material per 100 weight of elastomer in the article.

15. The article of claim 1, wherein the dry powdered material is applied to the dry wearer-contacting surface of the flexible impermeable elastomer glove according to a method of application comprising applying the dry powdered material to a dry wearer contacting surface of a dry flexible impermeable elastomer glove.

16. The article of claim 15, wherein the method of application is tumbling the flexible impermeable elastomer glove with the dry powdered material so as to contact the dry wearer contacting surface therewith.

17. The article of claim 15, wherein the dry powdered material is applied electrostatically to the dry wearer-contacting surface of the dry flexible impermeable elastomer glove.

18. The article of claim 15 wherein the dry powdered material is applied as an aerosol to the dry wearer-contacting surface of the flexible impermeable elastomer glove.

19. The article of claim 15 wherein the dry powdered material is applied from fluidized or non-fluidized beds of the dry powdered material to the dry wearer-contacting surface of the flexible impermeable elastomer glove prior to stripping the glove from a former.

20. The article of claim 1, wherein the dry powdered material is dry powdered Aloe, and wherein the elastomer is natural rubber latex, and wherein the article further comprises a dry additive applied to the dry wearer contacting surface, wherein the dry additive includes one or more of Vitamin E, Vitamin A, Vitamin C, and Vitamin D.

21. The article of claim 1, wherein the dry powdered material is dry powdered Nopal, and wherein the elastomer is natural rubber latex, and wherein the article further comprising a dry additive applied to the dry wearer contacting surface, wherein the dry additive includes one or more of Vitamin E, Vitamin A, Vitamin C, and Vitamin D.

* * * * *